US005983481A

United States Patent [19]

Müller

[11] Patent Number: 5,983,481

[45] Date of Patent: Nov. 16, 1999

[54] METHOD OF MAKING FORGED STEEL BAR

[75] Inventor: Hubert Müller, Grevenbroich, Germany

[73] Assignee: SMS Schloemann-Siemag AG, Dusseldorf, Germany

[21] Appl. No.: 08/996,847

[22] Filed: Dec. 23, 1997

[30] Foreign Application Priority Data

Dec. 23, 1996 [DE] Germany ..... 196 54 063

[51] Int. Cl.[6] ..... B21B 13/12

[52] U.S. Cl. ..... 29/527.7; 72/235

[58] Field of Search ..... 29/527.7, 33 C; 164/476, 417; 72/235, 224, 365.2, 366.2

[56] References Cited

U.S. PATENT DOCUMENTS 2,066,314 1/1937 Bartscherer .

FOREIGN PATENT DOCUMENTS 55 081 004 6/1980 Japan .
05 337 510 12/1993 Japan .
1273922 5/1972 United Kingdom ..... 29/527.7

OTHER PUBLICATIONS

"The Making, Shaping and Treating of Steel", Harold E.McGannon, United States Steel, Ninth Edition, 4 pages.
"Theoretische und Experimentally Untersuchungen Zum Formanderungsverlauf . . . ", Karl–Heinrich Tuke aus Dortmund/Rheinisch–Westfalischen Techninschen Hochschule Aachen, Oct. 22, 1979, 6 pages.
"Anbindung der Stranggiessanlage An Feinstahl–Oder Drahtwalzwerke" 2000 09 92 LD,Sep. 1992., U.Svejkovsky, 6 pages, SMS Schloemann–Siemag AG.
"High–Precision Rolling of Steelbars", SMS Schloemann–Siegmag Aktiengesellschaft, 2 pages.

*Primary Examiner*—P. W. Echols
*Attorney, Agent, or Firm*—Herbert Dubno; Andrew Wilford

[57] ABSTRACT

A steel bar is made by first producing a continuously cast forgeable steel strand of generally square cross section with flat beveled corners at a temperature above a transformation temperature. This strand is then cut into billets which are passed through a succession of pairs of rollers and compressed with the rollers with a pressure sufficient to compact a core of the billets without substantially lengthening the billets.

9 Claims, 2 Drawing Sheets

METHOD OF MAKING FORGED STEEL BAR

FIELD OF THE INVENTION

The present invention relates to the production of a forged steel bar. More particularly this invention concerns a method of and apparatus for producing forged steel bars with refined and/or compacted grain structure.

BACKGROUND OF THE INVENTION

The improvement of the mechanical properties of steel by forging has long been known. Intensive compression by pressing or hammering reduces coarse crystalline structure into a fine-grained structure and thus reduces the porosity of the material, compacts it, and improves its ductility. Forging produces a particle compaction with a concomitant length increase in the area of two to three times.

The dissertation entitled "Theoretische und experimentalle Untersuchungen zum Formänderungsverlauf and zu Spannungszustand an einer Schmiedewalzanlage (GFM/Krupp) zur Herstellung von Stabmaterial" ("Theoretical and experimental tests of shape change and tension conditions in a forging system (GFM/Krupp) for producing bar stock") by Dipl. Ing. Tuke of Dortmund, produced for the Rheinisch-Westfälischen Technischen Hochschulle Achen in October 1979 describes a continuous forging system. Here the workpiece is pummeled by a plurality of annularly arranged hammers that substantially compact it. The billet thus treated is in fact struck perpendicularly and crosswise as well as diagonally at a 45° angle to produce a workpiece with excellent grain structure. The system does not employ any rolling-mill technology and produces only a limited amount of finished workpieces.

In the periodical *Stahl und Eisen* (Vol. 110, No. 5, pp. 59–64) the high-precision rolling of bar stock in a fine steel wire installation of Moosstahl AG of Luzern, Switzerland is described. This publication discusses a high-pressure rolling system in a horizontal-roller frame and a vertical-roller frame. The method relates to the commercial production of bars with extremely accurately produced diameters and circular cross sections for fine steel and wire. There is no core compaction of the workpiece and none is intended.

The specialized literature *Walzwerksanlagen* (No. 2000.09.92 LD; September 1992; FIGS. 3 and 4) of SMS Schloemann-Siemag AG, of Dusseldorf, Germany shows the joining of a continuous-casting apparatus with a rolling installation for making fine steel out of billets. The goal here is a cost-efficient joining of the continuous-casting apparatus with the rolling installation so as to optimally use the latent heat in the strand.

OBJECTS OF THE INVENTION

It is therefore an object of the present invention to provide an improved system for making core-compacted steel bars.

Another object is the provision of such an improved system for making core-compacted steel bars which overcomes the above-given disadvantages, that is which has high productivity and low unit cost while producing a high-quality product.

SUMMARY OF THE INVENTION

A method of producing steel bar has according to the invention the steps of producing a continuously cast forgeable steel strand of generally square cross section with flat beveled corners at a temperature above a transformation temperature, passing the strand through a succession of pairs of rollers without twisting the strand, cutting the strand into billets and compressing the billets with the rollers with a pressure sufficient to compact a core of the billets without substantially lengthening the billets. The multi-step deformation, in particular in a rolling mill with two- or four-roller stands produces compaction in the core of the work-piece that greatly improves the mechanical characteristics of the bar thus produced.

According to the invention the rollers engage the beveled corners of the billets, normally using a four-roller stand. Such a procedure produces a compact core in the bar.

The strand in accordance with the invention has a cross sectional area of about 480 $cm^2$, a side length of about 22 cm, and a carbon content of 0.1% to 0.3% by weight. This ensures that realistic compaction and compression is achieved all the way into the core of the workpiece.

The strand is produced according to the invention by sequentially cooling a continuously cast strand until it is hard and its temperature is equalized, and cutting the strand into billets reheating the temperature-equalized billets, and prerolling the reheated billets by engagement of rollers against its beveled corners to impart to it a predetermined starting sectional shape with outwardly concave sides. Such a cross-sectional shape guarantees that the compaction will reach to the very center of the workpiece, producing a relatively uniform grain structure in the bar.

In accordance with a preferred embodiment of the invention the billets are passed through smoothing rollers immediately before being rolled out. In addition the rollers are part of two- and four-roller stands.

The instant invention further proposes the step of inductively reheating the billets. This prevents the workpiece from cooling excessively between succeeding deformations.

To achieve the extremely high pressures needed in accordance with the invention at least some of the rollers are small-diameter cylindrical rollers that are braced, for instance in four-high setups, to prevent them from bowing. These rollers are also driven. In some setups only two of the four rollers need be driven, for instance two driven horizontal rollers and two undriven vertical rollers. Normally however both the vertical and the horizontal rollers are driven.

To achieve best possible compacting the strand is produced by cutting it into billets and then twisting the billets through about 45° and thereafter prerolling the billets by engagement of respective horizontal and vertical rollers with respective diagonally opposite flat corners of the billets. More particularly the billets are twisted through about 45° between each set of rollers. This is done to reduce the cross-sectional height of the billets by about 10% during production of the billets and during subsequent rolling its cross-sectional height is reduced by between 30% and 60%. As a result there is minimal elongation. Finally the workpiece is finish rolled to impart to it an accurate cross-sectional shape.

A principal advantage of the invention is that continuously cast billets can be reduced to steel bar stock with refined and/or compacted grain structure. The still hot steel bar is immediately shaped into a finished product of accurate dimensions.

The apparatus for producing steel bar according to the invention has means for producing a forgeable steel strand of generally square cross section with flat beveled corners at a temperature above a transformation temperature, at least one rolling stand for prerolling the strand, a shear for cutting the strand into billets, a succession of pairs of vertical and horizontal rollers for compressing the billets with a pressure sufficient to compact a core of the billets without substantially lengthening the billets and for turning the billets between stands, and a reheater between the pairs of rollers for reheating the billets.

Roll stands are provided downstream of the pairs of vertical and horizontal rolls for finish rolling the billets. The means for producing a forgeable steel strand includes a continuous-casting device. The rollers are cylindrical and ungrooved.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
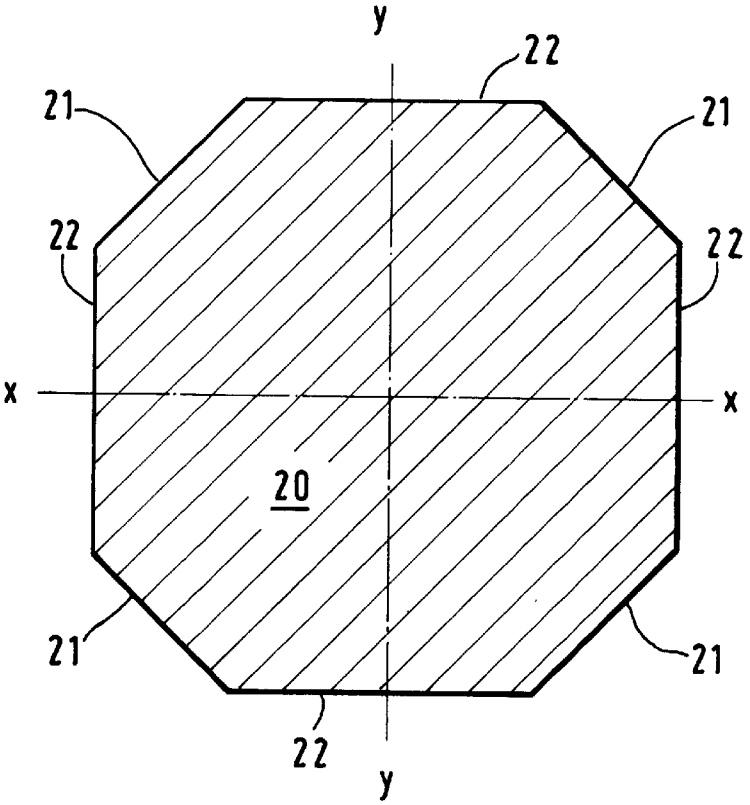
FIG. 1 is a cross section through a starting workpiece formed by a continuously cast billet or strand.

As seen in FIG. 1 a starting workpiece is formed by a strand or billet 20 of steel suitable for forging and made by continuous casting. The billet 20 has a nearly square cross section centered on a vertical plane y—y and a perpendicular horizontal plane x—x. It has sides 22 parallel to these planes and planar corners 21 that extend at 45° thereto.

Figure 2:
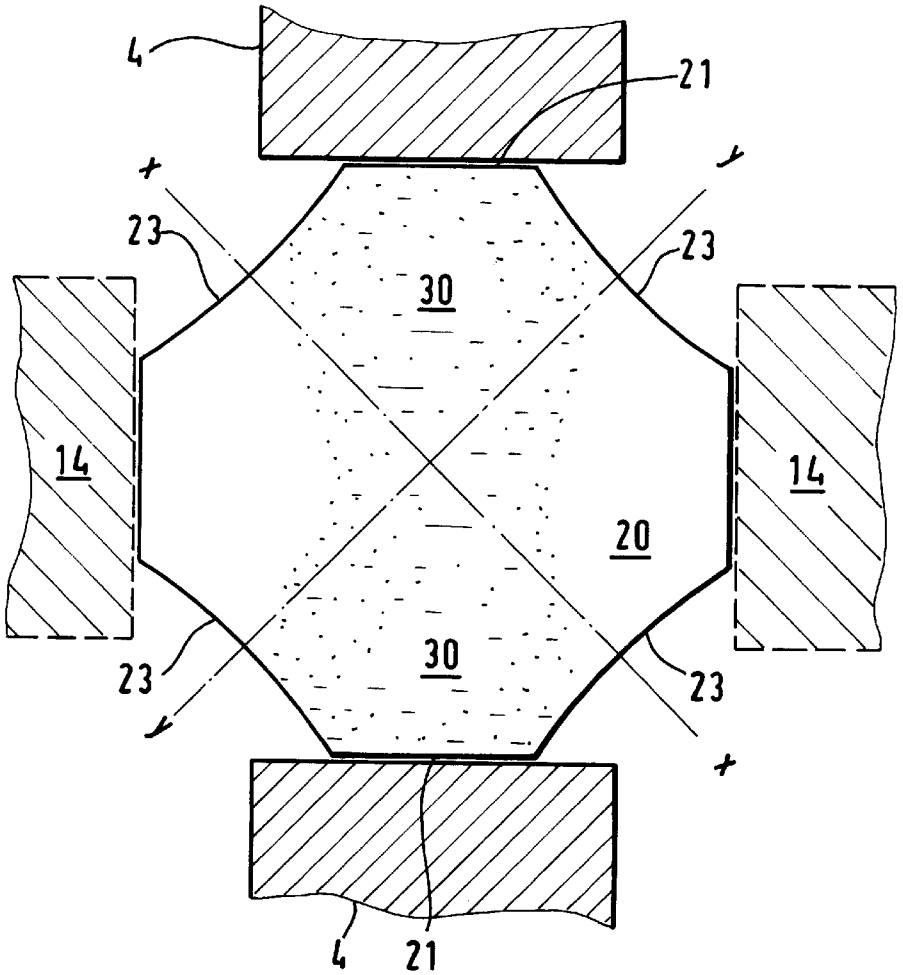
FIG. 2 is a cross section through the billet rotated through 45° and between a pair of horizontal rollers.

This workpiece 20 is produced (see FIG. 3) by cooling and hardening a continuously cast strand 10 until its temperature has equalized throughout its cross section, normally by use of an unillustrated curing oven. Then the strand 10 is passed through a shear 11 that cuts it into individual billets, this shear 11 being upstream or downstream of the curing oven. Then the billets 20 are smoothed and prerolled so that as shown in FIG. 2 the side surfaces 22 become concave surfaces 23. Subsequently the billets 20 are rotated through 45° and passed between a pair of horizontal rollers 4 that engage these planar corner faces 21 and compress the workpiece, compacting its core as shown at 30. FIG. 2 also shows the vertical rollers 14 of universal roll stands 5 and 7 (FIG. 3) having the horizontal rollers 4. In neither of the roll stands 5 or 7 is the workpiece lengthened substantially; instead most of the force serves to compact the core of the workpiece and thereby decrease its grain size, increase its density, and improve its ductility.

Figure 3:
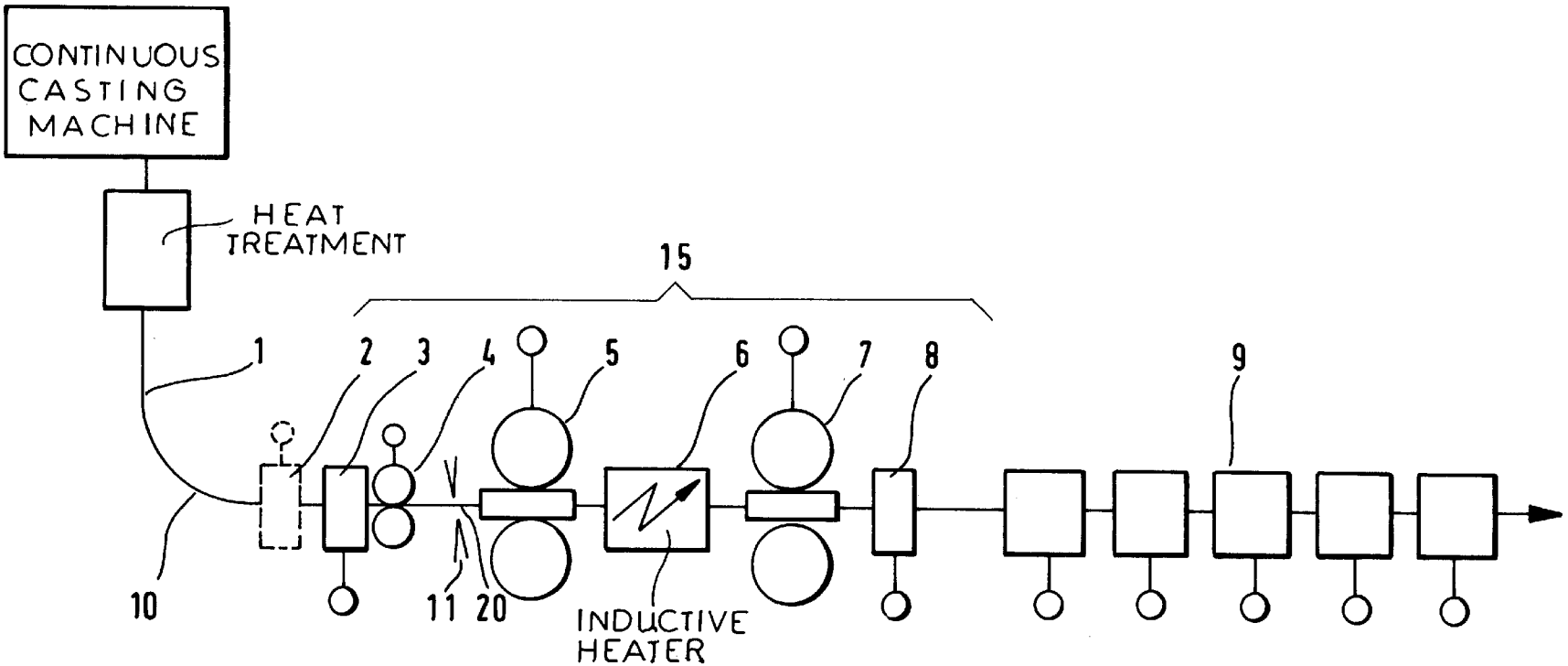
FIG. 3 is a diagram illustrating the method of this invention.

More particularly FIG. 3 shows a production stage wherein the strand 10 is continuously cast and heat treated. A prerolling assembly 2 establishes the starting shape and vertical and horizontal two-high roll stands 3 and 4 smooth it before it enters the shear 11 that cuts the strand into billets. The billets then pass through the two universal stands 5 and 7, each comprising horizontal rollers 4 and vertical rollers 14. An inductive heater 6 is provided between the roll stands 5 and 7 to keep the workpiece 20 hot enough. The rolls of the stands 5 and 7 are smooth and cylindrical, not grooved.

Following the upstream production line 15 formed by the elements 2–8 and 11 is a sequence of five finish-roller stands 9. Here the billets 20 with their cores 30 compacted are further rolled in a single heat.

I claim:

1. A method of producing steel bar, the method comprising the steps of:

a) producing a continuously cast forgeable steel strand of generally square cross section with flat sides and flat beveled corners;

b) equalizing the temperature of the strand through its cross section;

c) cutting the temperature-equalized strand into a succession of billets;

d) smoothing and prerolling the billets to make the flat sides outwardly concave;

e) reheating the smoothed and prerolled billets to above a transformation temperature of the billets;

f) twisting the heated billets through about 45° and passing them through at least one pair of vertical and one pair of horizontal rollers and engaging the corners therewith to compress the billets with a pressure sufficient to compact the core of the billets without significantly lengthening the billets; and g) passing the heated billets between at least one more pair of vertical and one more pair of horizontal rollers and engaging the flat sides therewith to compress the billets with a pressure sufficient to compact a core of the billets without significantly lengthening the billets.

2. The method defined in claim 1 wherein the strand has a sectional area of about 480 $cm^2$, a side length of out 22 cm, and a carbon content of 0.1% to 0.3% by weight.

3. The method defined in claim 1 wherein the rollers of steps f) and g) are part of two-high and four-high roller stands.

4. The method defined in claim 1, further wherein during step e) the billets are inductively reheated.

5. The method defined in claim 1 wherein at least some of the rollers are small-diameter cylindrical rollers.

6. The method defined in claim 1 wherein at least some of the rollers are of small diameter and are driven.

7. The method defined in claim 1 wherein the rollers include driven vertical rollers and driven horizontal rollers.

8. The method defined in claim 1 wherein during step f) the cross-sectional height of the strand is reduced by about 10% and during step g) its cross-sectional height is reduced by between 30% and 60%.

9. The method defined in claim 1, further comprising the step of h) finish rolling the strand to impart thereto an accurate cross-sectional shape.

* * * * *